US005136771A

United States Patent [19]

Lang

[11] Patent Number: 5,136,771

[45] Date of Patent: Aug. 11, 1992

[54] METHOD OF KEEPING AN EASILY REMOVABLE MAT OR THE LIKE SMALL CARPET IN PLACE

[75] Inventor: Aage Lang, Kolind, Denmark

[73] Assignee: Milliken Denmark A/S, Morke, Denmark

[21] Appl. No.: 577,843

[22] Filed: Sep. 4, 1990

Related U.S. Application Data

[62] Division of Ser. No. 423,847, Oct. 19, 1989, abandoned.

[51] Int. Cl.[5] ..... B23P 19/04; B32B 3/06

[52] U.S. Cl. ..... 29/450; 29/401.1; 29/402.01; 428/95

[58] Field of Search ..... 29/401.1, 402.01, 402.03, 29/402.04, 402.08, 446, 450; 16/4, 8; 52/385, 511, DIG. 13, 747; 428/95, 99

[56] References Cited

U.S. PATENT DOCUMENTS

| | | | |
|---|---|---|---|
| 3,408,705 | 11/1968 | Kayser et al. | 52/511 |
| 4,530,870 | 7/1985 | Brazier | 428/95 |
| 4,731,275 | 3/1988 | Andersen | 428/95 |
| 4,748,063 | 5/1988 | Reuben | 428/99 X |
| 4,804,567 | 2/1989 | Reuben | 428/95 X |

*Primary Examiner*—Joseph M. Gorski
*Assistant Examiner*—Peter Dungba Vo
*Attorney, Agent, or Firm*—Earle R. Marden; H. William Petry

[57] ABSTRACT

In a method for keeping an easily removable mat or similar small carpet (5) in place in a carpeted or carpet tile covered area (1) of a floor, the mat (5) is provided with a pattern of engageable means, such as projections (6), distributed all over its lower side. One or more parts (2) of the floor area (1) to be covered by the mat (5) is kept or made free from carpeting or carpet tile covering, and said one or more uncovered parts (2) of the floor area (1) is provided with an anchoring plate material (7), the upper surface of which is performed with engageable to engage the lower side of the mat (5) for preventing a horizontal displacement of the mat. Then the mat (5) is arranged in place for covering the anchoring plate material (7) and for engagement between its lower side and the upper surface of the anchoring plate material (7). Thereby is obtained that the mats may be easily replaced and no risk occurs for the people walking on the carpeted area (1) during the replacement.

1 Claim, 3 Drawing Sheets

METHOD OF KEEPING AN EASILY REMOVABLE MAT OR THE LIKE SMALL CARPET IN PLACE

This application is a division of Ser. No. 07/423,847 filed Oct. 19, 1989, now abandoned.

The present invention relates to a method of keeping an easily removable mat or similar small floor carpet in place in a carpeted or carpet tile covered floor area In a known method a non-carpeted area corresponding to the mat dimensions is provided in the carpeted area, and the mat is arranged in said non-carpeted area, whereby the mat is held in place at its edges by which it abuts the borders of the carpeted area. Said method is unfavorable seeing that the mat being loosely arranged therein is difficult to fit properly into the cut away area in the carpeted area, and said area by replacement of the mat with a new mat will rarely fit properly to the new mat, whereby the mat either is too small or too large for the area thus provided.

To eliminate said drawbacks this invention provides a method which is characterized in that the mat is provided with a pattern of engageable means, such as projections, distributed all over its lower side, and that one or more parts of the floor area to be covered by the mat is kept or made free from carpet or tile covering, that said one or more uncovered areas of the floor area is/are provided with cover plate material, the upper surface of which is so performed with engageable means as to engage the lower side of the mat in order to prevent a horizontal displacement of the mat, and that the mat is arranged in place for covering the anchoring plate material and providing an engagement between its lower side and the upper surface of the anchoring plate material by means of said engageable means. Thereby the mat fits to the area of the anchoring plate material, and seeing that the mat always is arranged upon the carpeted area and upon the anchoring plate material, the mat dimensions need not be particularly accurate, seeing that they just should be larger than the area of the anchoring plate material.

In a preferred embodiment of the method the anchoring plate material has a thickness essentially corresponding to the thickness of the carpet or carpet tile covered floor area, whereby it is achieved that a mat arranged upon the anchoring plate material is safely prevented against a sidewise displacement.

BRIEF DESCRIPTION OF THE DRAWINGS

The invention will now be explained in more detail in connection with some embodiments and with reference to the drawing in which.

DETAILED DESCRIPTION

Figure 1:
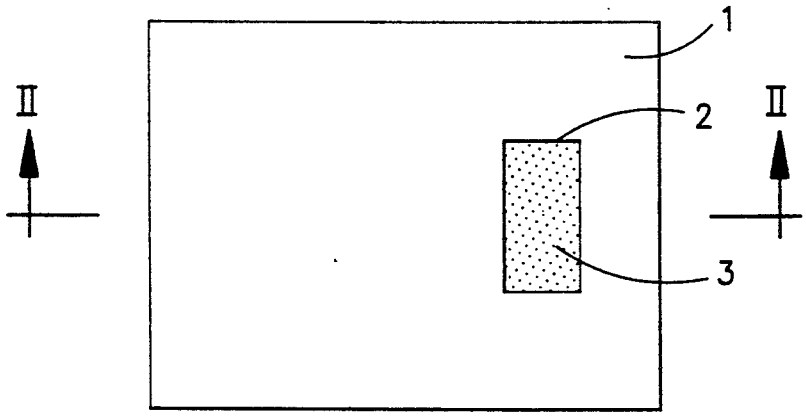
FIG. 1 shows a carpeted area with a prior art cut away area, into which a prior art mat has been placed.
Figure 2:
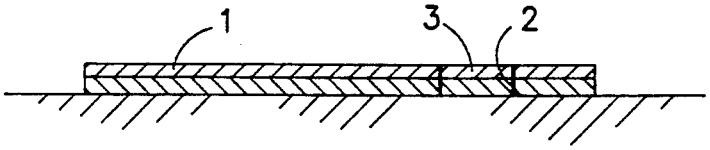
FIG. 2 shows a section along II—II in FIG. 1.

FIG. 1 shows a carpeted area 1 with a recess 2, into which is placed a prior art mat 3 of smaller dimensions than those of the recess 2. FIG. 2 shows that the mat 3 should be somewhat smaller than dimensions of the recess 2 in order not to be too difficult to replace. Such arrangement causes much wear to the edges of the recess, especially if the mat is of the kind to be frequently replaced. This is due to the fact that the mat does not protect the edges of the carpeted area at the recess, and that dust may inevitably fall into the recess at the edges of the mat 3, whereby the dust removal, e.g. by means of a vacuum cleaner, will cause wear to the edges of the recess.

Figure 3:
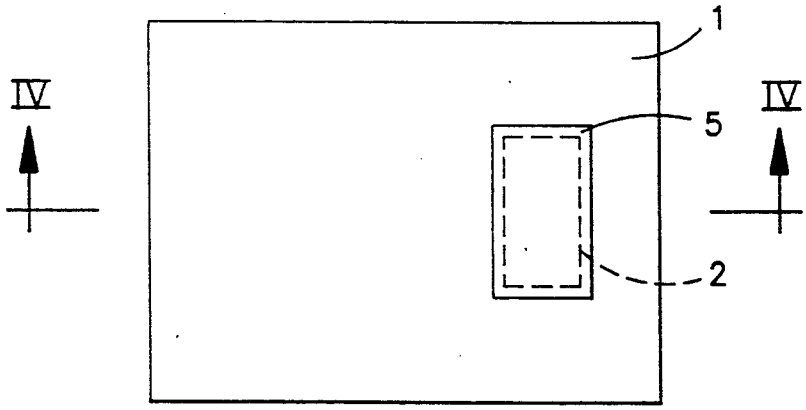
FIG. 3 shows a carpeted area, where a mat according to the method of the invention is arranged upon an area equipped with an anchoring plate material.
Figure 4:
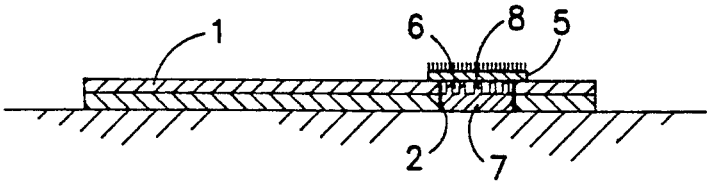
FIG. 4 shows a section along IV—IV in FIG. 3.

FIGS. 3 and 4 illustrate the method according to the invention, whereby a mat 5 is applied, which before its use is provided with a pattern of engageable means, such as cleats or projections, distributed all over its lower side. One or more parts 2 of the floor area 1 to be covered by the mat 5 is/are kept or made free from carpet. Each of said uncovered parts 2 of the floor area 1 is then provided with an anchoring plate material 7, the upper surface of which is performed so as to engage the lower side of the mat 5 to prevent a horizontal displacement thereof. The mat 5 is then laid in place for covering or overlapping the anchoring plate material 7 and its lower side engages the upper surface of the anchoring plate material. FIG. 4 shows the arrangement after placing the anchoring plate material 7 in the recess 2, and the lower side engaging means 6 of the mat 5 engage the engaging means 8 on the upper surface of the anchoring plate material 7.

Figure 5:
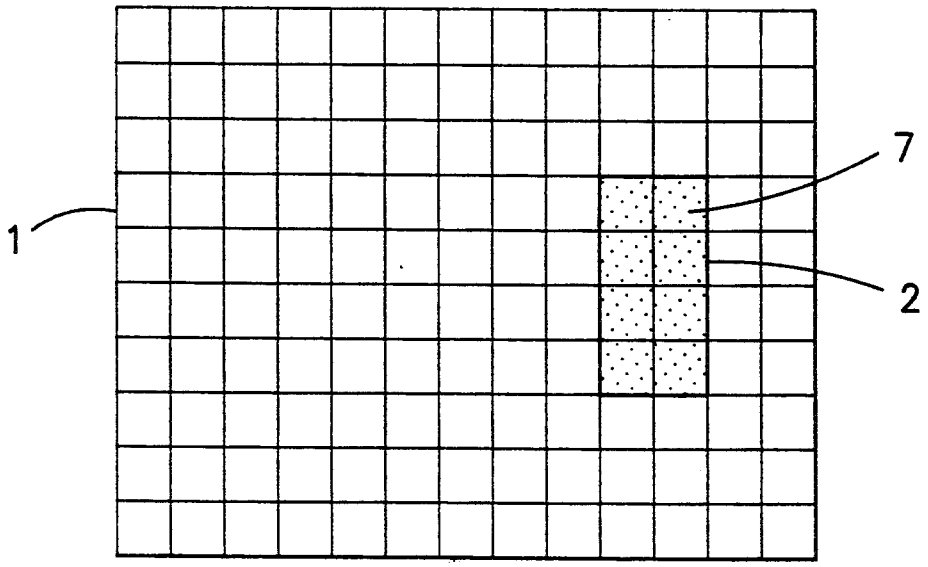
FIG. 5 shows a carpet tile covered area, wherein — according to the invention — corresponding tiles of anchoring plate material are inlaid.
Figure 6:
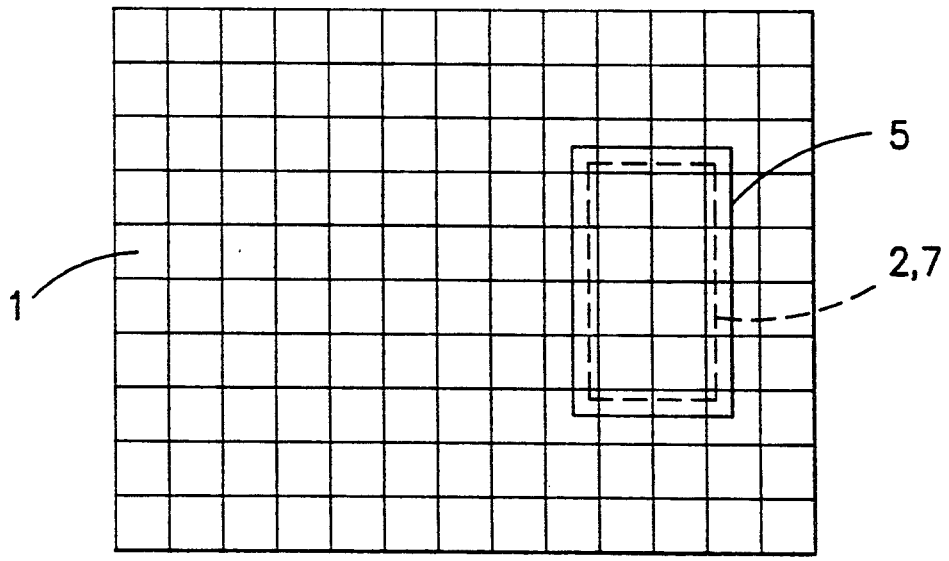
FIG. 6 shows FIG. 5, whereby a mat is placed upon the anchoring plate material.

FIGS. 5 and 6 show an arrangement with a carpet tile covered area, wherein six carpet tiles are removed and replaced by six tiles of anchoring plate material 7 whereupon the mat 5 is placed onto the tile covered area so as to overlap or cover the six tiles 7 of anchoring plate material serving as an underlay of the mat. Thereby a safe anchoring of the mat to its underlay is achieved, and no increased wear of the carpet material edges of the recess occurs. In cases where the mat 5 is temporarily not arranged in place, e.g. being replaced, the carpet tile covered area appears unbroken without open recesses which might be risky for people walking on the carpeted area.

FIG. 6 shows the mat 5 placed upon and covering the area which is provided with the inlaid anchoring plate material 7.

Figure 7:
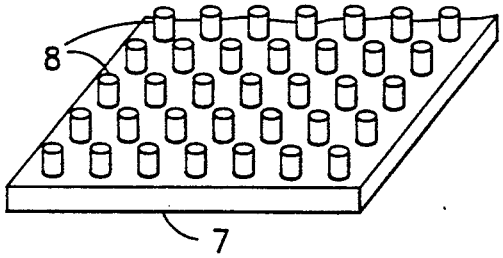
FIG. 7 shows a cover plate material tile having a cleat pattern at its upper side.

FIG. 7 shows an example of a tile of anchoring plate material, the upper surface of which is provided with a number of cleats or projections fitting into the pattern of cleats or projections on the lower side of the mat 5, so that the projections of the mat are placed between the projections 8 of the anchoring plate material 7.

Figure 8:
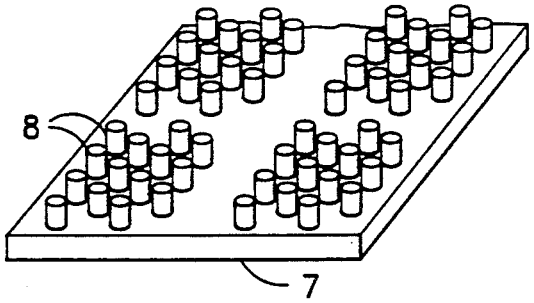
FIG. 8 shows a tile with a different cleat pattern in the upper surface of the anchoring plate material.

FIG. 8 too allows a tile of anchoring plate material 7, whereby the cleats or projections 8 are grouped in a particular way, so that they also allow the projections 6 on the lower side of the mat 5 to engage in between said projections 8.

Figure 9:
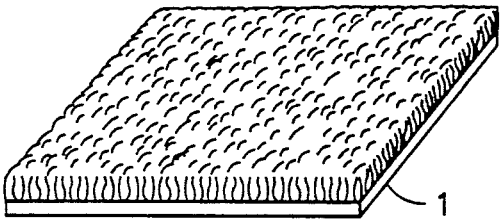
FIG. 9 shows a prior art carpet tile.

FIG. 9 shows a known carpet tile of predetermined module dimensions which are the same as the module dimensions for the tiles of anchoring plate material 7. Also the height of the carpet tile shown in FIG. 9 may preferably be the same as the height of the tiles of anchoring plate material.

Figure 10:
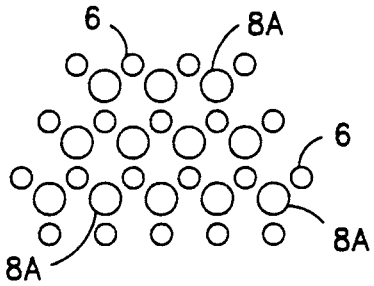
FIG. 10 shows schematically the engagement between cleats or projections on the lower side of the mat and cleats or projections on the upper surface of the anchoring plate material.

FIG. 10 shows an example of engagement between the projections 6 of the mat 5 and the projections 8A of the anchoring plate material 7. It appears that the projections 8A are so big that they may be arranged inside a group of three projections 6.

Figure 11:
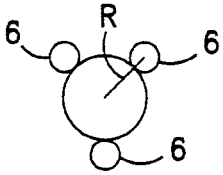
FIG. 11 shows an inscribed circle touching three cleats or projections on the lower side of the mat.

FIG. 11 shows the borderline case for the size of the projections 8A which, although their cross sectional diameter is larger than the mutual distance between a pair of mat projections 6, should have a smaller diameter than a circle having the radius R, and which is touching a group of three adjacent mat projections 6.

Figure 12:
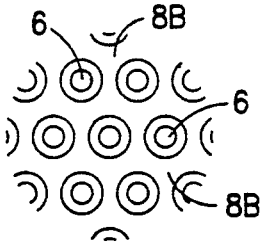
FIG. 12 shows schematically an example of an engagement between the lower side pattern of the mat and the upper surface pattern of the anchoring plate material.
Figure 13:
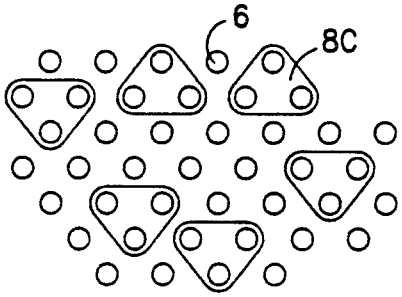
FIG. 13 shows schematically a different embodiment of an engaging arrangement between the lower side projections of the mat and the upper surface projections of the anchoring plate material.

FIGS. 12 and 13 show two further embodiments of projections 8B, 8C, respectively, on the upper surface of the anchoring plate material 7, where the projections 8B and 8C form a pattern of banks or beads for individual and groupwise inclusion, respectively, of projections 6 on the lower side of the mat 5.

As example of dimensions of tiles of anchoring plate material 7 may be mentioned quadratic tiles having an edge length of 20 × 20 cm, 40 × 40 m and 80 × 80 cm, a thickness of 4–10 mm, the material being natural or synthetic rubber, PVC, PUR or other plastics, such as polymers or thermoplastic materials. Instead of cleats or projections on the lower side of the mat 5 and the upper surface of the anchoring plate material 7, respectively, so-called Velcrofastener materials may be used, provided that they meet the condition of being able to keep a removable mat in place on covering materials 7 inlaid into a carpet or carpet tiles covered area.

The lower side of the anchoring plate material 7 may be smooth or provided with a friction pattern or a friction covering, but the lower side may also be intended for being secured by adhesion.

I claim:

1. Method of keeping an easily removable mat or similar carpet in place on a carpeted or carpet tile covered floor area comprising: laying a carpet over a floor area and leaving a portion of the floor area uncarpeted placing a first mat with cleats thereon in the uncarpeted area with the cleats on the mat projecting upwardly with the tips thereof substantially co-planar with the previously layed carpet, providing another mat having outside dimensions greater than the uncarpeted floor area and having cleats in the bottom thereof and placing the other mat on top of the first mat with the cleats on both mats engaging one another and the edge of the other mat being extended beyond the edge of the uncarpeted area.

* * * * *